US006298532B1

(12) United States Patent
Walt, II

(10) Patent No.: US 6,298,532 B1
(45) Date of Patent: Oct. 9, 2001

(54) SEAT ASSEMBLY MACHINE INCLUDING SELECTIVELY ACTUATED SCREW FOR ADJUSTING AXES OF THE MACHINE TO ASSEMBLE DIFFERENT SIZES OF SEAT COVERS ON PADDED SEAT FRAMES

(75) Inventor: Michael Allen Walt, II, DeKalb, IL (US)

(73) Assignee: LMS Walt, Inc., DeKalb, IL (US)

( * ) Notice: Subject to any disclaimer, the term of this patent is extended or adjusted under 35 U.S.C. 154(b) by 0 days.

(21) Appl. No.: 09/356,925

(22) Filed: Jul. 19, 1999

(51) Int. Cl.[7] ..... B68G 7/00

(52) U.S. Cl. ..... 29/91; 29/91.5; 29/235; 29/713; 74/89.15

(58) Field of Search ..... 29/91, 91.5, 235, 29/713; 74/89.15

(56) References Cited

U.S. PATENT DOCUMENTS 4,385,427 * 5/1983 Fraiser ..... 29/91.5
5,774,965 * 7/1998 Mintz et al. ..... 29/91.5
6,000,292 * 12/1999 Nagai et al. ..... 74/89.15

* cited by examiner

*Primary Examiner*—David P. Bryant
*Assistant Examiner*—John C. Hong
(74) *Attorney, Agent, or Firm*—Leydig, Voit & Mayer, Ltd.

(57) ABSTRACT

A seat assembling machine commonly known as a skinner or stuffer is adjustable in several axes to allow the machine to be adjusted for different sizes/configurations of seats and seat covers. The machine includes a carriage which is driven towards a padded seat frame. The carriage includes a plurality of generally parallel stanchion rods that can be selectively spaced apart along two different perpendicular axes to receive a selected size of seat cover. The machine inserts a seat cover outside out over padded seat frames. The carriage may selectively rotated, selectively translated forward or horizontally and selectively tilted to better align the stanchion rods with the padded seat frame.

20 Claims, 12 Drawing Sheets

SEAT ASSEMBLY MACHINE INCLUDING SELECTIVELY ACTUATED SCREW FOR ADJUSTING AXES OF THE MACHINE TO ASSEMBLE DIFFERENT SIZES OF SEAT COVERS ON PADDED SEAT FRAMES

FIELD OF THE INVENTION

The present invention generally relates to methods and machines for assembling car seats and more particularly to machines for assembling a cover onto a padded seat frame.

BACKGROUND OF THE PRESENT INVENTION

There are several known machines for installing upholstery seat covers onto padded automobile seat frames. Such machines are commonly referred to as skinners by those skilled in the art. Some skinners operate vertically above an on-line conveyor which transports the seat through several stations, while other skinners are off-line or stand alone wherein seats are manually transported to the next assembly station.

One such prior skinner machine is disclosed in Fraiser, U.S. Pat. No. 4,385,427. Fraiser provides a carriage having a cluster of resilient cantilever arms that extend downward. In operation, an inside-out seat cover is slipped over the resilient arms. Then the carriage is translated towards a padded seat frame. The cantilever arms move along the outer of the padded seat frame causing the cover to be turned outside-out over the padded seat frame. A drawback with Fraiser is that it is unable to accommodate different sizes of seats. In particular, different models of vehicles have different sizes and shapes of seats which require different cover sizes. It is a disadvantage that this requires automotive manufacturers to have a different machine for each different size or shape of seat, and does not allow manufactures the flexibility to increase production of a certain size of seat that may be in short supply or inventory. This also can cause the skinner machine to become obsolete or require re-tooling if the particular seat size is discontinued by the automotive manufacturer. Another related problem is that the disclosed skinner machine of Fraiser can not be installed in an on-line seat assembly conveyor.

Another attempt at providing a skinner machine is disclosed in Mintz et al., U.S. Pat. No. 5,774,965. The skinner machine of Mintz includes self adjusting pneumatic actuators that drive four blades. At the beginning of the fitting cycle, the four blades are grouped close together so that a seat cover can be inserted inside-out on the blades. Then the blades are pneumatically actuated outward from one another to exert radially outward pressure on the seat cover. The seat cover counteracts the pneumatic force to stop the movement of the blades. Once the blades are stopped, a padded seat frame is driven towards the blades to skin the seat cover onto the padded seat frame outside-out. One very significant problem of Mintz is that the outward pressure on the seat covers causes an undesirable number of seat covers to pop or rip which results in wasted seat covers which in turn is very costly. Although Mintz et. al asserts to be adjustable for different sizes of seats by using pneumatic "self adjusting" actuators, the reality is that little if any adjustability is achieved and that a fixed sized seat cover and configuration is optimal for any given machine. Therefore, differently configured skinner machines are still necessary for different sizes of seat covers. Yet another problem of Mintz et. al is that the disclosed skinner can not be installed nor easily adapted to be installed in an on-line seat assembly conveyor.

One last problem of Mintz is the quality of the skinned cover on the padded seat frame is low because the skinned cover on the seat usually has wrinkles and poor alignment which must be manually corrected, which is time-consuming and costly.

SUMMARY OF THE PRESENT INVENTION

It is therefore a general object of the present invention to provide a machine for assembling a cover on a padded seat frame that overcomes these and other problems existing in the art.

It is a specific object of the present invention to provide a highly reliable machine for assembling a cover on a padded seat frame that is more readily adjustable for multiple different sizes of seats.

It is another objective of the present invention to more precisely locate the cantilever arms of a machine for assembling a cover on a padded seat frame.

In accordance with these and other objective, the present invention provides a machine for assembling a cover on a padded seat frame that includes at least one actuated screw which drives the cantilever arms closer together or farther apart to a selected spacing for the desired size of seat cover. The screw precisely locates the cantilever arms to receive a selected size of seat cover.

It is a feature of the present invention to provide a machine for installing seat covers on padded seat frames that is adjustable along several axes. The machine includes a frame that carries a carriage. A cluster of cantilever arms extend longitudinally away from the carriage in a Y axis. The cantilever arms are selectively spaced apart in X and Z axes for receiving a selected size of seat cover. A plurality of the cluster of arms can be selectively moved with respect to the carriage in at least one of the X and Z axes to a plurality of selected positions that correspond to a selected size of seat cover. The spacing between arms may be adjusted when it is desired to use a different size of seat cover by a selectively rotated screw. The machine further includes an actuator that facilitates reciprocating movement in the Y axis between the carriage and padded seat frames.

It is a feature of the present invention that the machine can be easily built for operation with an on-line conveyor or in operation as a stand alone.

It is an aspect of the present invention according to one embodiment that the carriage is movable with respect to the frame in the Z axis which allows the padded seat frame to be aligned with the cantilever arms when the cantilever arms have been moved. The machine may include an electrical actuator for selectively positioning the carriage in the Z axis.

It is another aspect of one embodiment that the carriage is rotatable about the Y axis with respect to the frame. This allows worker easier access to different sides of the seat to finish assembly of the seat cover on the padded seat frame. An appropriate rotary motor such as an electrical motor or pneumatic motor selectively positions the carriage in the desired angular position.

DETAILED DESCRIPTION OF THE PREFERRED EMBODIMENT

Figure 1:
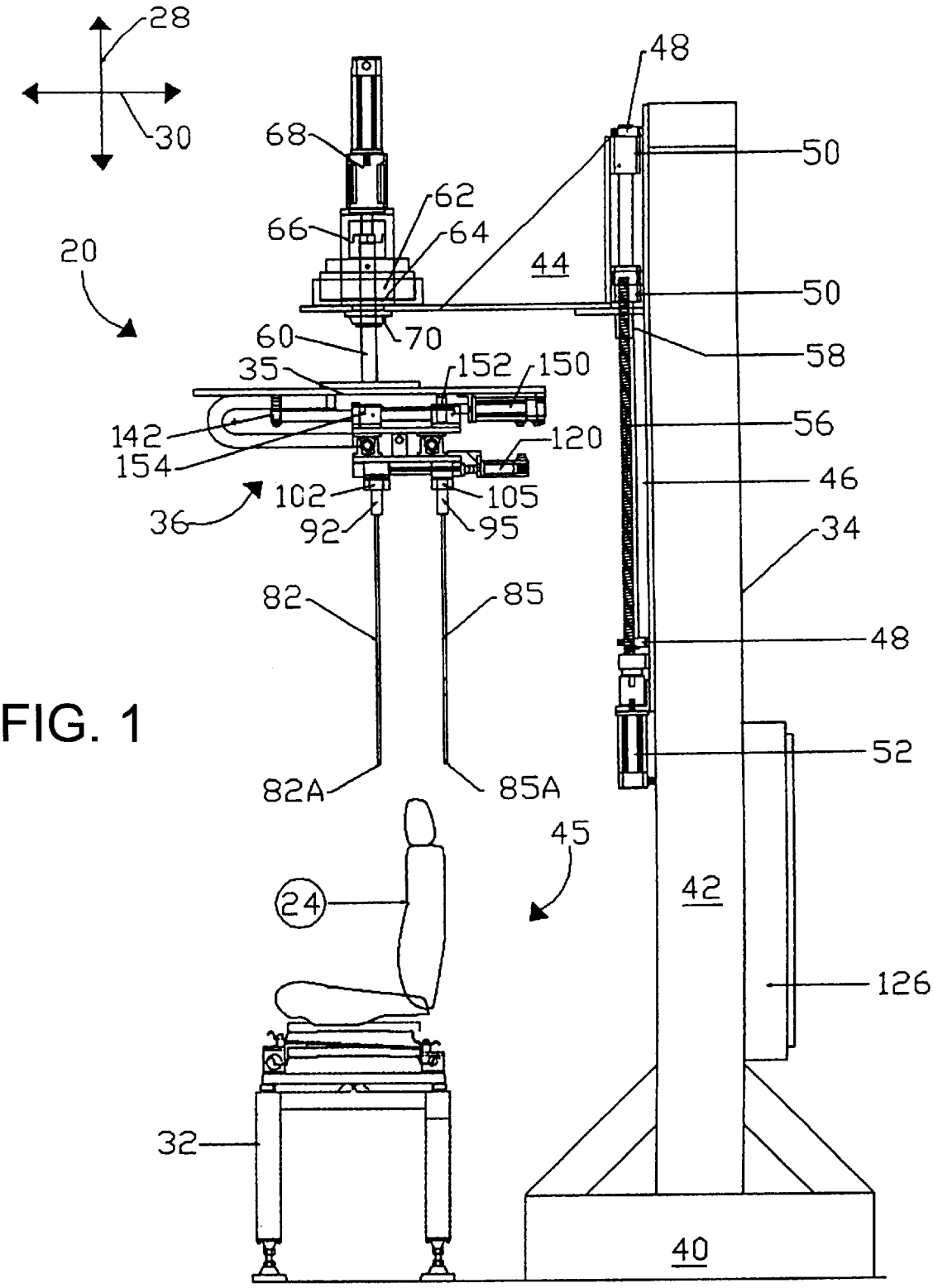
FIG. 1 is a side view of a machine for assembling covers on padded seat frames according to a preferred embodiment.
Figure 2:
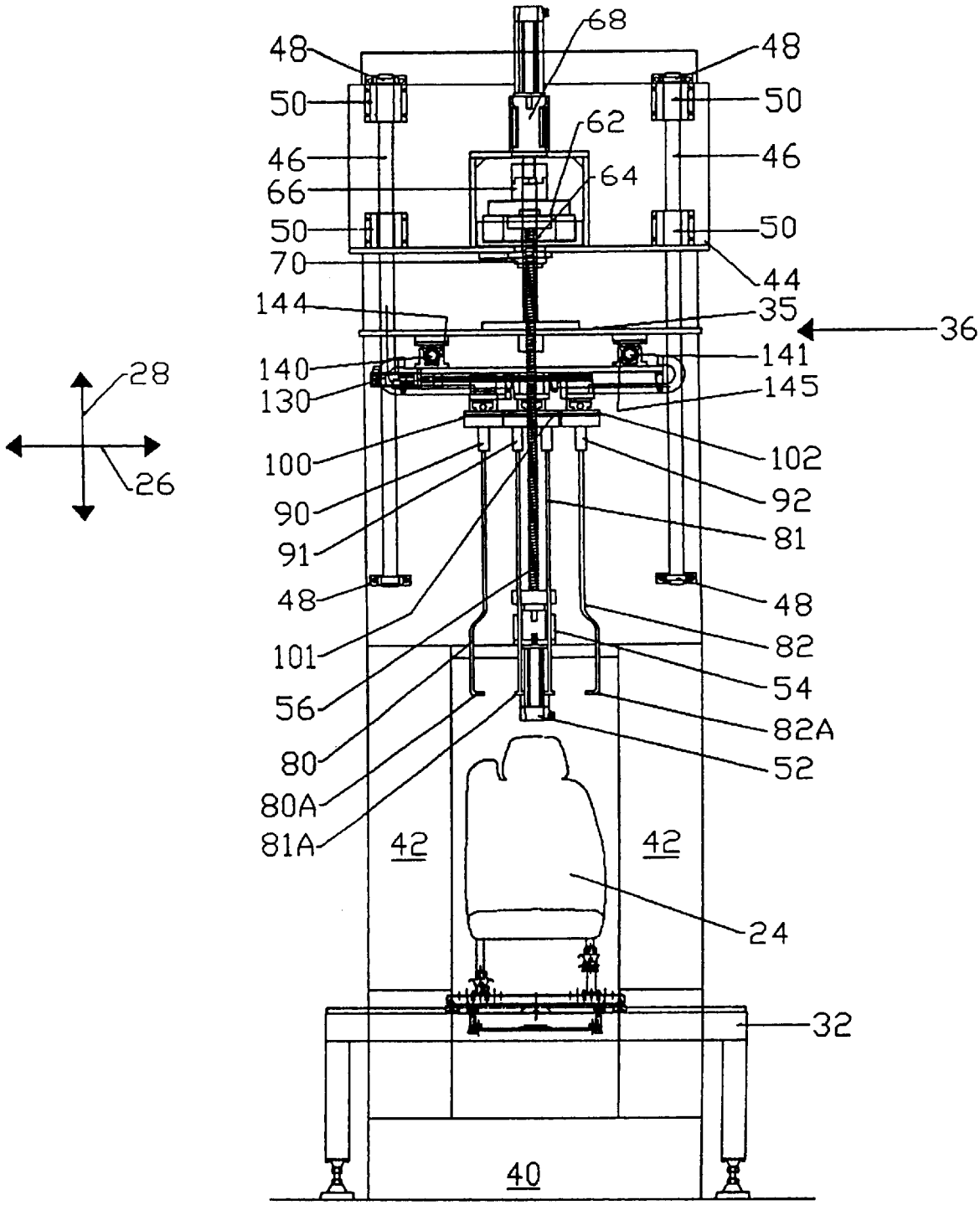
FIG. 2 is a front elevational view of the machine of FIG. 1.
Figure 3:
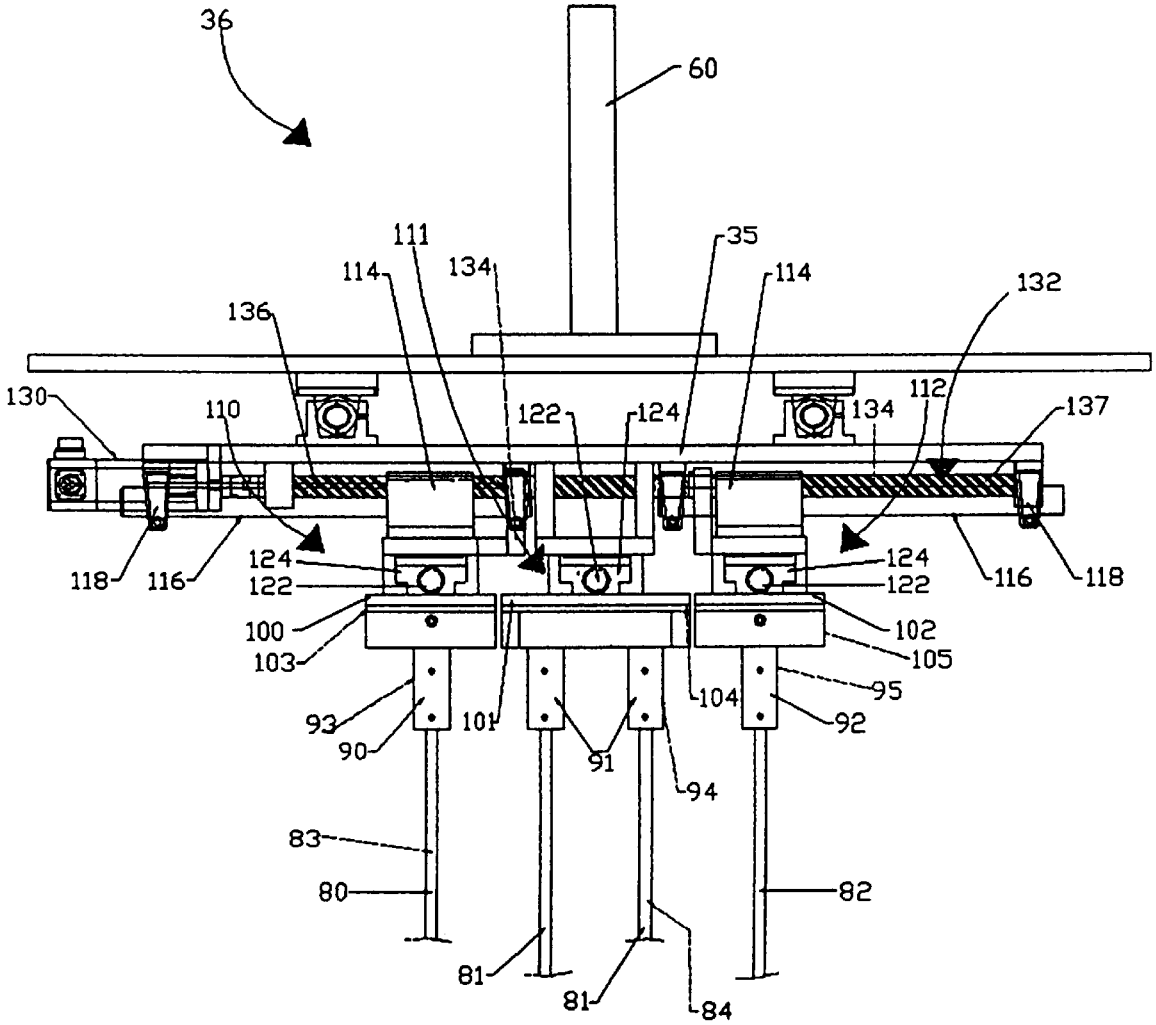
FIG. 3 is an enlarged fragmentary view of the carriage shown in FIG. 2.
Figure 4:
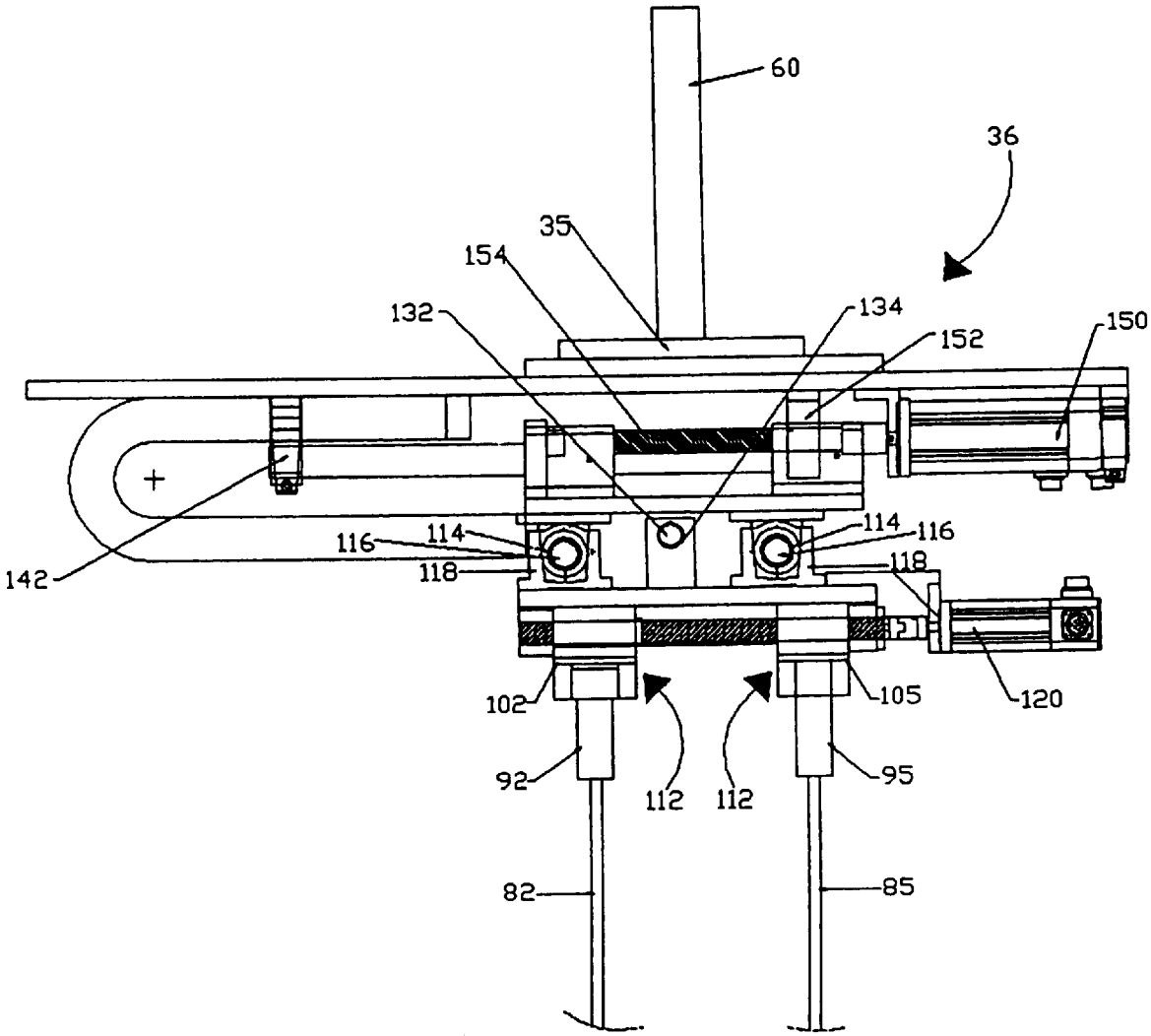
FIG. 4 is an enlarged fragmentary view of the carriage shown in FIG.

A machine 20 for assembling covers on padded seat frames 24 is illustrated in FIGS. 1 and 2, according to a first embodiment of the present invention. For the purpose of providing an easier understanding of the present invention, an X axis 26, a Y axis 28 and a Z axis 30, which are generally perpendicular with one another, are illustrated in the Figures. The machine 20 of FIGS. 1 and 2 is positioned over an exemplary online conveyor assembly 32 that supports a padded seat frame 24 in an upright position and transfers the padded seat frames 24 through several assembly stations (not shown). The conveyor assembly 32 shown is one built by TECHNO INDUSTRIES, which are common in many seat assembly plants. It will be understood that the conveyor assembly 32, padded seat frames 24 are illustrated to facilitate easier understanding of the present invention but are not part of the present invention.

The machine 20 includes a frame 34 that supports a carriage 36. The frame 34 includes a support base 40, a vertical support member 42 and a horizontal support member 44. The vertical support member 42 is rigidly fixed to the support base 40 and extends vertically upward therefrom to support the horizontal support member 44 in a cantilever fashion. The frame 34 defines a void generally indicated at 45 that receives the online conveyor assembly 32.

The horizontal support member 44 is movable vertically in the Y axis 28 with respect to the vertical support member 42. A pair of guide rods 46 attached by brackets 48 guide the movement of the horizontal support member 44. Linear bearings 50 affixed to the horizontal support member 44 slidably engage the guide rods 46. A rotary electrical actuator in the form of a servo motor 52 is connected via a love joy coupling 54 to a screw shaft 56 of a ball screw that is mounted on the vertical support member 42 for driving the horizontal support member 44 and therefore the carriage 36. The horizontal support member 44 has a ball nut 58 affixed thereto that threadingly engages the screw shaft 56 to transfer rotary power into linear translation. An advantage of using the combination of electrical actuation with the ball screw for driving the carriage is that the motion of the carriage is relatively constant and does not jerk which achieves more uniform assembly of the seat cover on the padded seat frame as compared with a pneumatic cylinder.

In accordance with an aspect of the present invention, an electronic controller 126 selectively operates the servo motor 52 to adjust the driven distance between the stanchion rods 80–85 and the padded seat frames 24. This provides for easy adjustment in one axis to facilitate easier change over between different types of seats and seat lengths. Different adjustment settings can be stored in the electronic controller 126 such that change over between different seat lengths can be done electronically without any mechanical adjustment.

However in alternative embodiments, it will be appreciated that other actuators as conventional in prior art systems may be used for facilitating the reciprocating movement such as a pneumatic cylinder other such actuating means as appropriate. A hydraulic cylinder may also be used as the actuating means to achieve more constant motion as the fluid is not compressible, however hydraulic actuation is expensive and requires a separate hydraulic power unit.

A support shaft 60 is rotatably mounted to the horizontal support member 44. The support shaft 60 has an upper end that is supported radially and axially by a tapered roller thrust bearing 62 that is affixed to the horizontal support member 44. A support disc 64 that is pinned and fitted in a recess of the shaft 60 prevents the shaft 60 from dropping downward. The upper end of the shaft 60 is connected through a love joy coupling 66 to an electrical rotary motor 68, pneumatic rotary motor, or other means for positioning the shaft 60 to a selected angular position. A flange bearing collar 70 prevents upward movement of the drive shaft that may occur when the carriage 36 is driven downward over the padded seat frame 24. The lower end of the shaft 60 is fixed to a carriage support 35 that supports the carriage 36.

A cluster of cantilever arms in the form of stanchion rods 80–85 extend downward from carriage 36 in the Y axis and are generally parallel with one another. Each rod has its supported end fixed into a corresponding stanchion support sleeve 90–95. The center support sleeves 91, 94 are connected to respective stanchion support bases 101, 104. The corner support sleeves 90, 92, 93, 95 are connected to respective corner support bases 100, 102, 103, 105.

Figure 11:
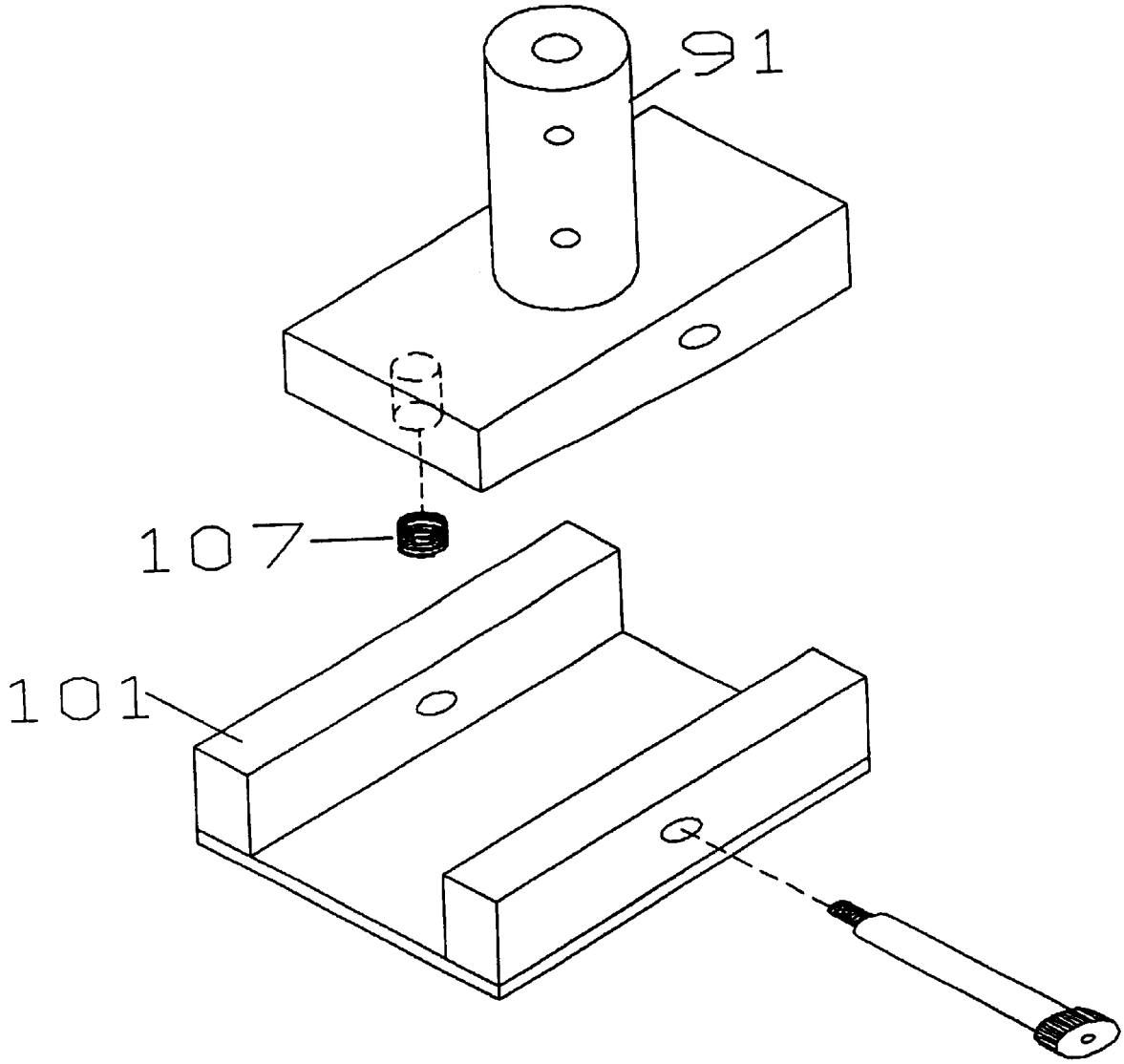
FIG. 11 is an exploded view of an exemplary corner stanchion base assembly for use with the first and second embodiments.
Figure 12:
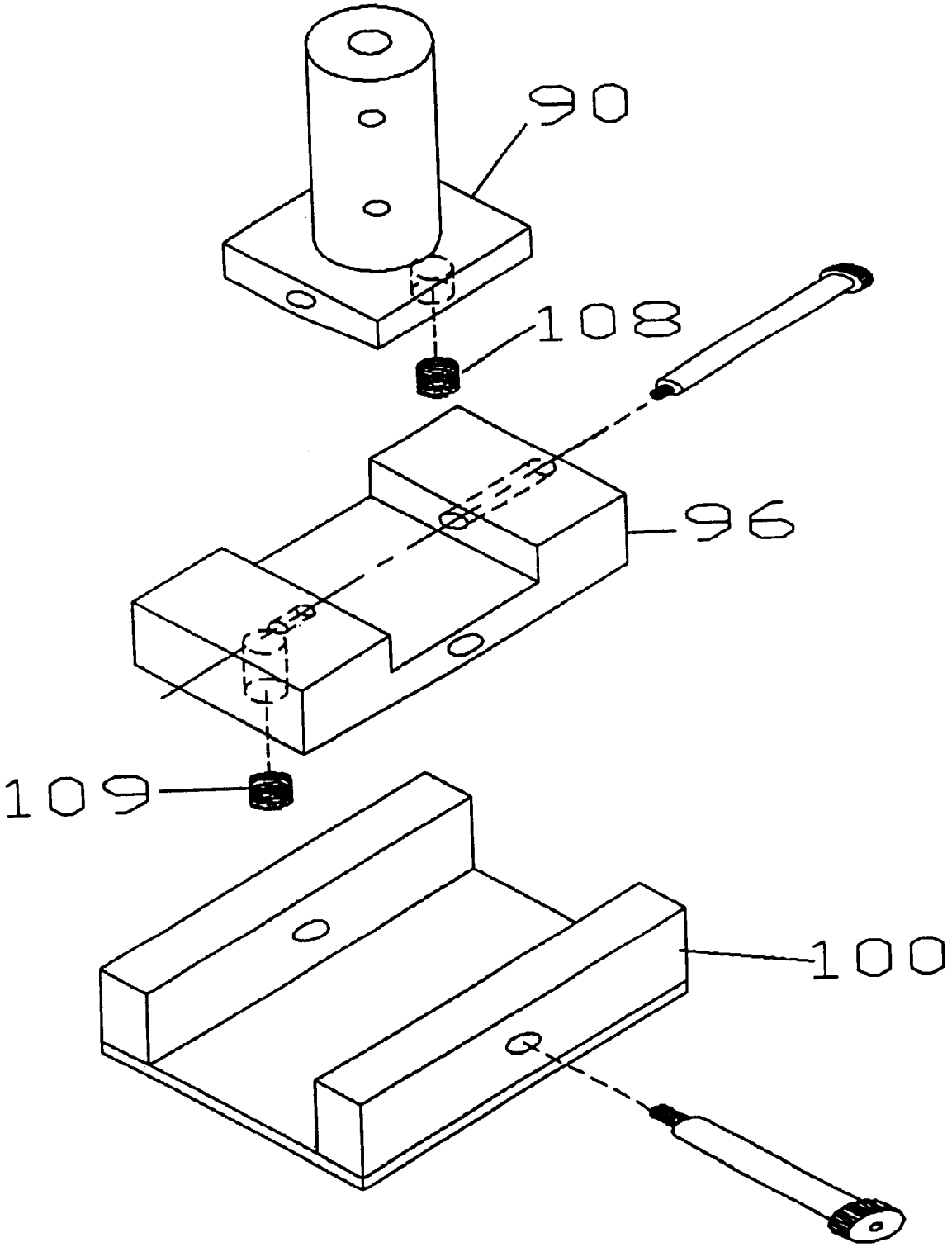
FIG. 12 is an exploded view of an exemplary center stanchion base assembly for use with the first and second embodiments.

The stanchion rods 80–85 are preferably pivotably connected to the carriage 36 such that the outer extremities or unsupported ends **80*a*–85*a* of the rods 80–85 have limited range of movement in the X and/or Z axes 26, 30. Alternatively, the stanchion rods 80–85 may be rigidly fixed to the carriage 36 such that only bending in the rods allows for movement of the unsupported ends 80*a*–85*a*. In any event, the rods 80–85 are supported in a cantilever fashion. In the preferred embodiment, the unsupported ends 80*a*, 82*a*, 83*a*, 85*a* of the corner rods 80, 82, 83, 85 are have a limited range of outward movement from one another in the X and Z axes 26, 30, while the unsupported ends 81*a*, 84*a* of the center rods 81, 84 have a limited range of outward movement from one another in the Z axis 30 only. The guide rods are biased inward toward one another by springs mounted in the support bases. An exemplary center support base is illustrated in FIG. 11 illustrating how a center rod is capable of the pivot moment about one axis. An exemplary corner support base is illustrated in FIG. 12** indicating how a corner support rod is capable of pivot movement about two different axes. Both of the pivot mechanism are known by those of skill in the art and have been used on prior art seat assembly machines.

In the preferred embodiment, a spring 107, or other resilient means biases each center stanchion support sleeve 91, 94 and therefore each center stanchion rod 81, 84 to an unengaged position. The corner stanchion support sleeves

90, 92, 93, 95 are pivotably connected to respective intermediate stanchion support sleeve 96–99 that are pivotably connected to respective stanchion support bases 100, 102, 103, 105. A pair of spring 108, 109 or other resilient means biases the corner stanchion support sleeves 90, 92, 93, 95 and therefore the each corner stanchion rod 80, 82, 83, 85 inward toward each other. The stanchion support bases 100–105 have their positions fixed with respect to the carriage 36 during operation. However, stanchion support bases 100–103, and 105 are movably mounted on the carriage 36 with respect to the X and/or Z axes 26, 30 while rear center stanchion support base 104 is rigidly fixed to the carriage 36. It will be appreciated that other configurations for cantilever arms or stanchion rods and bases can also be used in the present invention.

In accordance with the present invention, a plurality of the cluster of stanchion rods 80–85 are selectively movable towards and away from each other to selected positions for receiving a selected size of seat cover. This feature allows the stanchion rods 80–85 to be selectively spaced for receiving a variety of different seat cover sizes. As previously mentioned, the center rear support base 104 is rigidly fixed to the carriage 36. The carriage includes three boxways 110, 111, 112 that each include a rail and track and that carry the other support bases 100–103, 105. The outer boxways 110, 112 are mounted for sliding movement towards and away from each other in the X axis 26, while the center boxway 111 is fixed to the carriage 36 with respect to the X axis 26. The outer boxways 110, 112 each include a pair of liner bearings 114 that slidably engage a corresponding pair of guide rods 116 for support thereby. The guide rods 116 are secured to the carriage via brackets 118.

In accordance with the present invention, at least one screw is provided to selectively space apart the stanchion rods 90–95. In the preferred embodiment, an electrical actuator 130 (in the preferred form of a servo motor) drives a screw shaft 132 threaded into receiving sleeves 134 of the outer boxways 110, 112, known by those skilled in the art as an acme screw mechanism. The screw shaft 132 is divided into two portions 136, 137 which have opposite hand threading so that rotation of the screw shaft 132 results in opposing movement of the boxways 110, 112 along the guide rods 116 so that they move towards or away from each other at equal distances. Thus, the screw shaft 132 acts on the corner support bases 100, 102, 103, 105 through the boxways 110, 112. In an alternative embodiment, a dedicated motor may be provided for each outer boxway to drive each boxway in the X axis independent of the other. The screw may also directly threadingly engage the support bases.

In accordance with another aspect of the present invention, the front support bases 100, 101, 102 are mounted for sliding movement in their respective boxways 110, 111, 112 for independent movement in the Z axis by at least one screw. In the preferred embodiment, electrical rotary motors 120 (in the preferred form of servo motors) drive respective screw shafts 122 in respective threaded sleeves 124 (acme screw mechanisms) of the boxways 110, 111, 112. As such the screw shafts 122 drive the front support bases 100, 101 102 in the boxways 110, 111, 112 so that the front stanchion rods 80, 81, 82 are selectively movable in the Z axis 30 as desired. This achieves separate linear movement of the desired support bases and stanchion rods in two separate axes to move the rods closer together or farther apart as determined by the size and configuration of the seat cover and frame to be stuffed.

It is a feature of the present invention according to the instant embodiment, that the carriage 36 is movable relative to the frame 34 in the Z axis 30, and more particular movable relative to the carriage support 35. The carriage support 35 carries a pair of guide rods 140, 141 aligned with the Z axis 30 that are mounted thereon by brackets 142. The carriage 34 has affixed thereto linear bearings 144, 145 that slide on the guide rods 140, 141 to allow for movement of the carriage 34 in the Z axis 30. An electrical actuator 150 is mounted on the carriage support 35 as well. The electrical actuator 150 drives a screw shaft 152 which engages a threaded sleeve 154 that is part of the carriage 34.

A programmable electronic controller 126 (an exemplary unit of which is a SLC 500 made by ALLEN-BRADLEY that can be programmed through an ALLEN-BRADLEY PANEL VIEW 1000 or compatible operator interface) can be operated by a worker to selectively actuate each of the actuators 52, 68, 120, 130, 150. The electronic controller 126 includes a control board with switches to actuate each of the actuators independent of each other. To facilitate easier understanding of the drawings, the electrical wiring that connects the electronic controller 126 to the actuators and control board have not been illustrated.

In operation, the machine 20 is configured for the specific size of seat frame and seat cover that is desired. More specifically, the stanchion rods 80–85 are selectively spaced apart in the X and Z axes by selectively operating the electrical actuators 120, 130. Accomplishing this in the simplest manner can be done by trial and error by repeatably fitting a seat cover over the rods and slowly jogging the rods 80–85 via electrical actuation. Alternatively, this may be accomplished by fitting a seat cover thereon with electrical feedback from the actuators that provides an appropriate signal that stops the actuators once the cover is contacted. The positions of the stanchion rods 80–85 may be programmed into memory if the electronic controller and electrical actuators are configured for such operation. Another option is with machine vision technology that takes a digital photograph of the seat cover, measures the seat cover and inputs data to the electronic controller 126 to selectively position the stanchion rods 80–85 to the desired positions.

The stanchion rods 80–85 are selectively spaced by virtue of the stanchion bases 100–105 being fixed in the X and Z axes as the electrical actuators 120, 130 hold the position of the stanchion bases 100–105. Although servo motors which drive a screw shaft are shown, other electrical actuation may be used such as a rotary stepper motor. Another alternative is to attach the rotary screw shafts to dial mechanism which can be manually rotated to selectively position the stanchion rods, with the positions of the stanchion rods being indicated on a scale on the dials. Acme screws and nuts will be used with the dial mechanism to hold the positions of the rotary screw shafts and therefore the stanchion rods once the stanchion rods are selectively positioned. Such manually actuated mechanical actuating mechanisms may achieve a more cost efficient machine. In any event, the position of the screws which in turn position the stanchion rods are selectively moved and then locked into position to keep the stanchion rods in the desired position for receiving the seat cover.

Once the stanchion rods 80–85 are spaced, the stanchion rods 80–85 may need to be aligned with a padded seat frame 24 which may be held in a fixed position. To accomplish this, the carriage 34 may be selectively positioned in the Z axis 30 by operating the appropriate electrical actuator 130. The electrical actuator 130 then holds the position of the carriage 34 in the Z axis 30.

Another optional feature is that the carriage 36 may also be tilted about the X axis to better align the stanchion rods

80–85 with the alignment angle of the padded seat frames (not shown) if so desired. This may be particularly advantageous for machines in which the stanchion rods are not capable of pivoting movement relative to the carriage.

After the stanchion rods 80–85 are selectively spaced and the carriage 34 is adjusted in the Z axis 30 if necessary, the machine 20 is ready to skin seat covers on padded seat frames. This is accomplished by inserting a seat cover inside out over the stanchion rods 80–85 which are fixed in position. A padded seat frame 24 is then situated under the carriage 34 on the conveyor assembly 32. Then the appropriate electrical actuator 52 or other appropriate actuation means is operated to drive the carriage 34 down upon the padded seat frame in the Y axis 28. During movement, the cover is turned outside out over the padded seat frame 24. More specifically, the outer extremities or unsupported ends 80*a*–85*a* of the stanchion rods 80–85 move in cooperation with the respective springs 107, 108, 109 to engage and closely following the contour of the padded seat frame 24 to install the seat cover on the padded seat frame 24. After that, the seat cover and frame 24 may be rotated about the Y axis if necessary to allow a worker easy access for finishing operations of the seat such as velcro setting or hog ringing. The carriage 34 is the retracted and the finished skinned padded seat frame (not shown) is removed. Once retracted, the machine 20 is ready to install another seat cover on a padded seat frame 24 and the step specified in this paragraph is repeated over and over again.

Once it is desired to change the seat size, the machine 20 can be easily reconfigured as discussed above. It is an advantage that no retooling of the machine is necessary to reconfigure this machine 20 of the present invention and that the machine may be reconfigured as many times as desired. By providing the various adjustments as noted above, the resulting quality of the skinned seats is very high. In another alternative embodiment of the present invention, it may also be possible for the programmed electronic controller to have a program that operates the electrical actuators 120, 130 during the reciprocating movement of the carriage 34 to move the outer extremities of the stanchion rods more closely around the contour of the padded seat frames. This will allow for a higher degree of quality for unusual seats with extreme contours such as bucket seats for sports cars.

Figure 5:
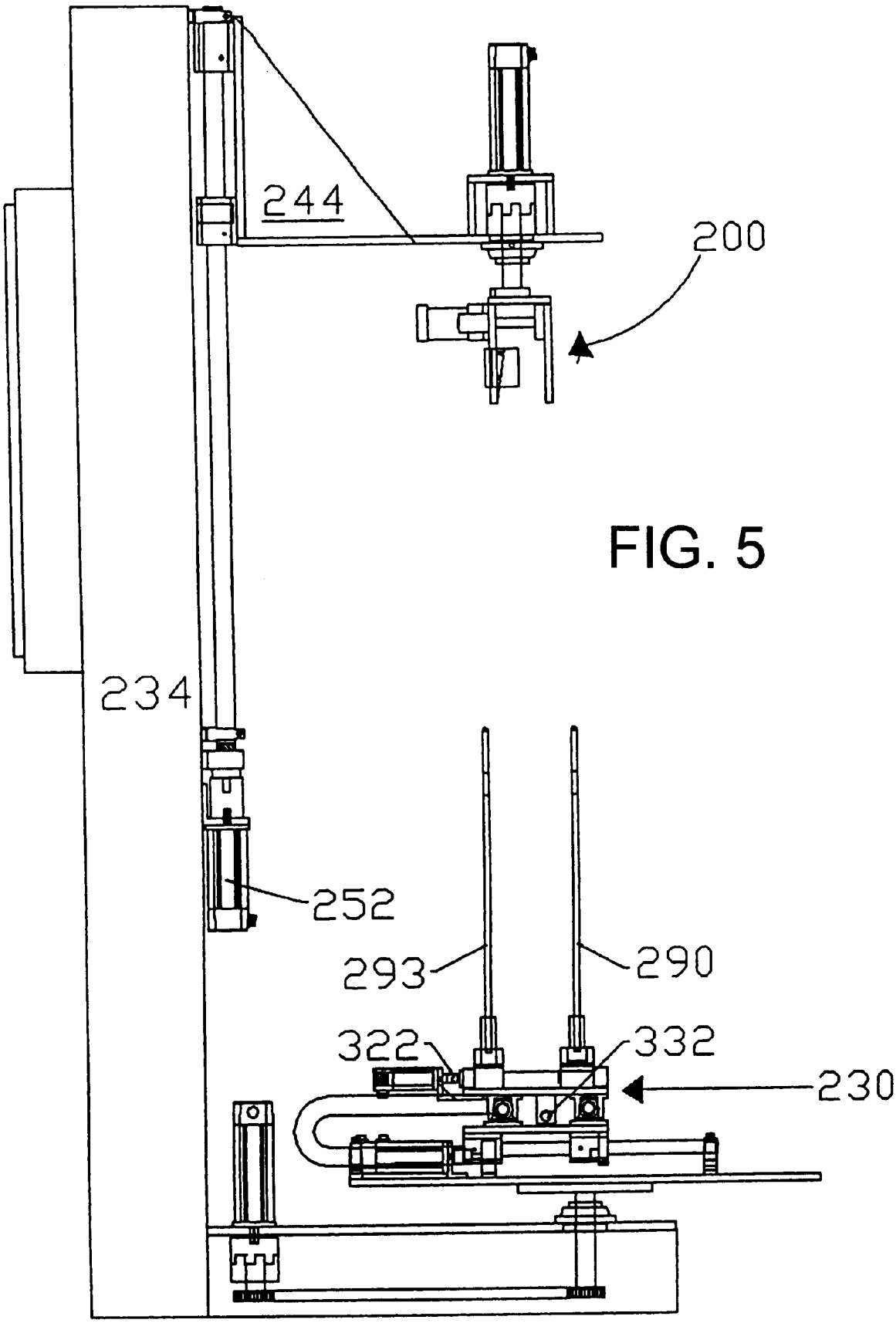
FIG. 5 is a side view of a machine for assembling covers on padded seat frames according to a second embodiment of the present invention.
Figure 6:
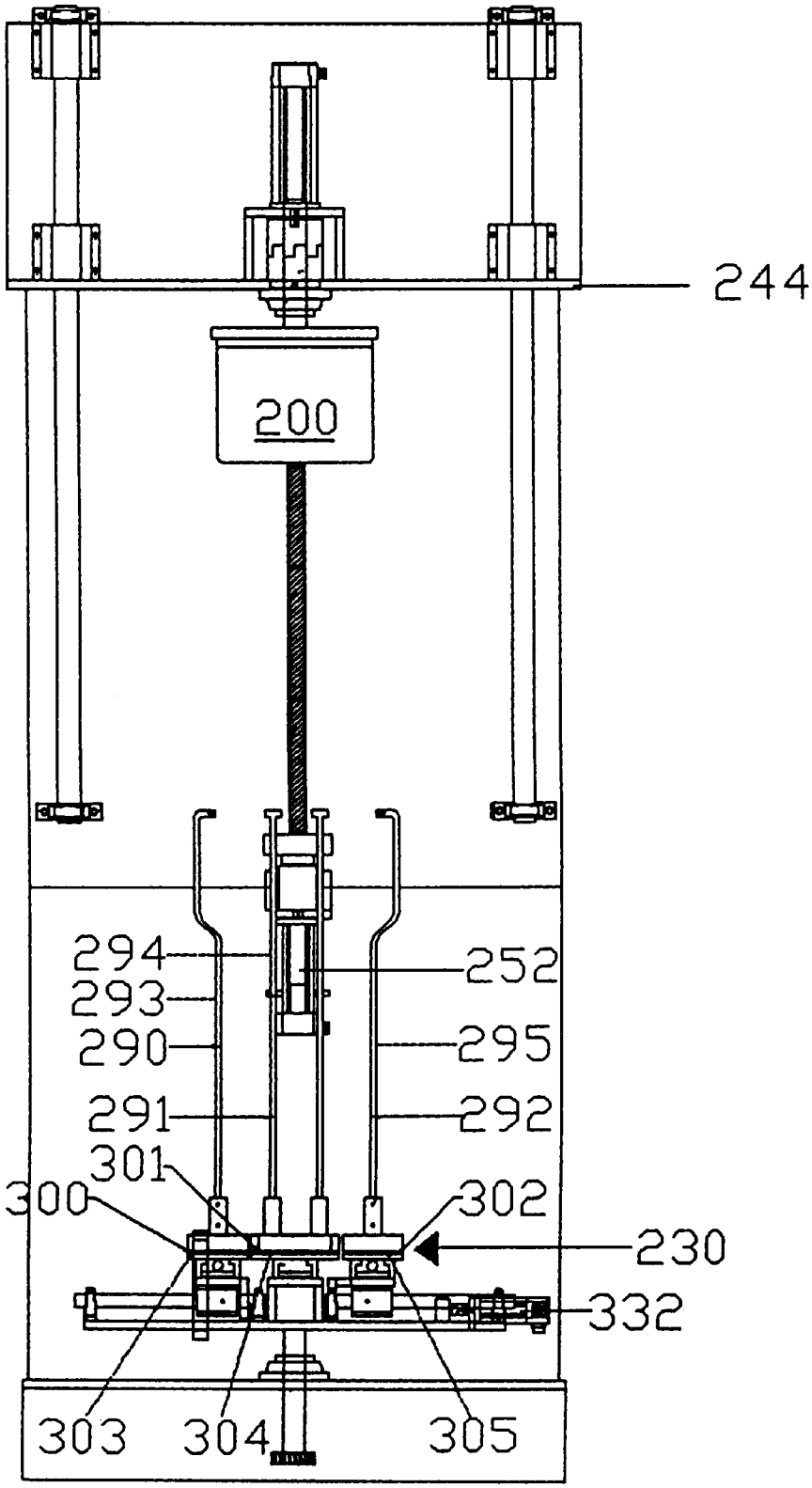
FIG. 6 is a front elevational view of the machine of FIG. 5.
Figure 7:
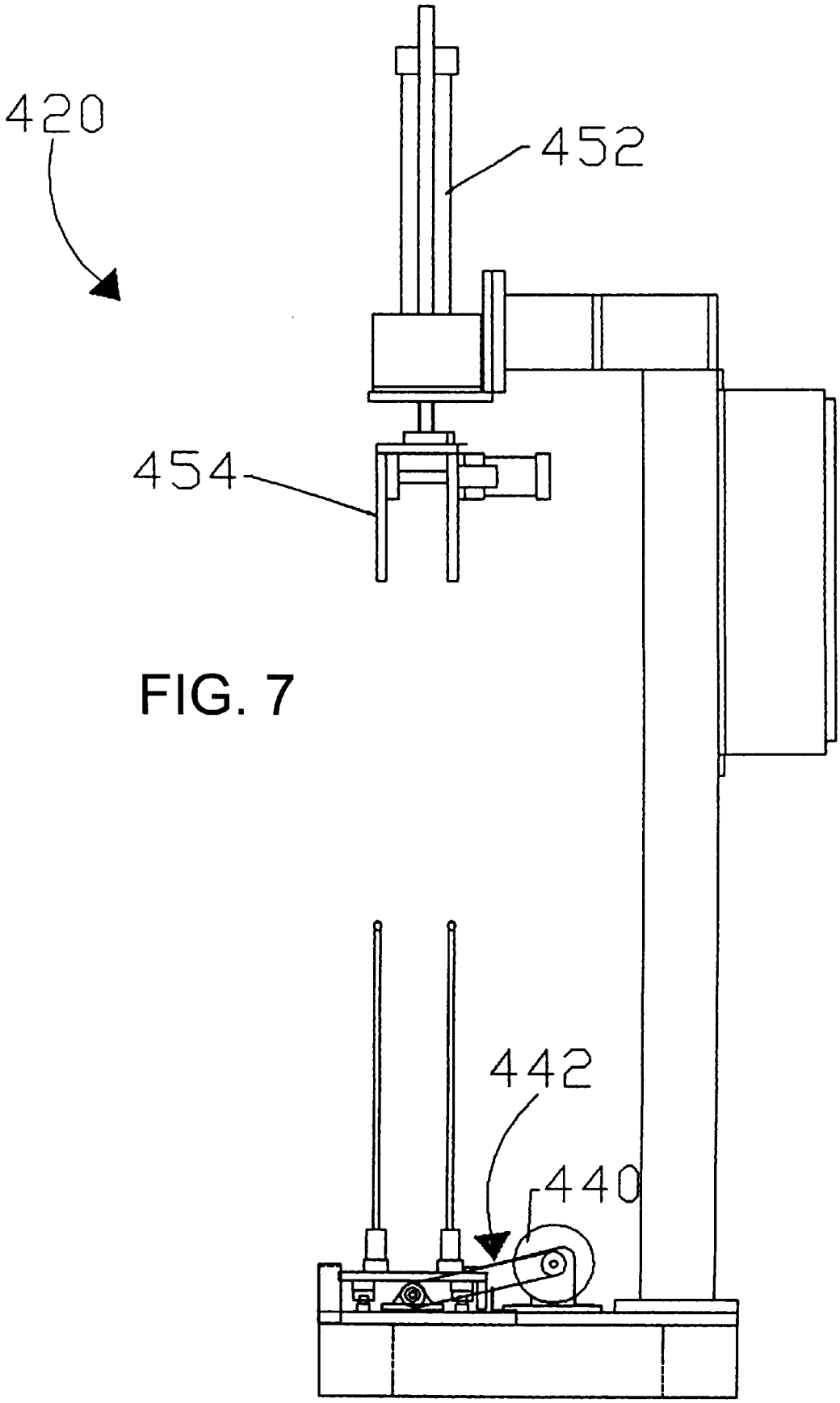
FIG. 7 is a side view of a machine for assembling covers on padded seat frames according to a third embodiment of the present invention.
Figure 8:
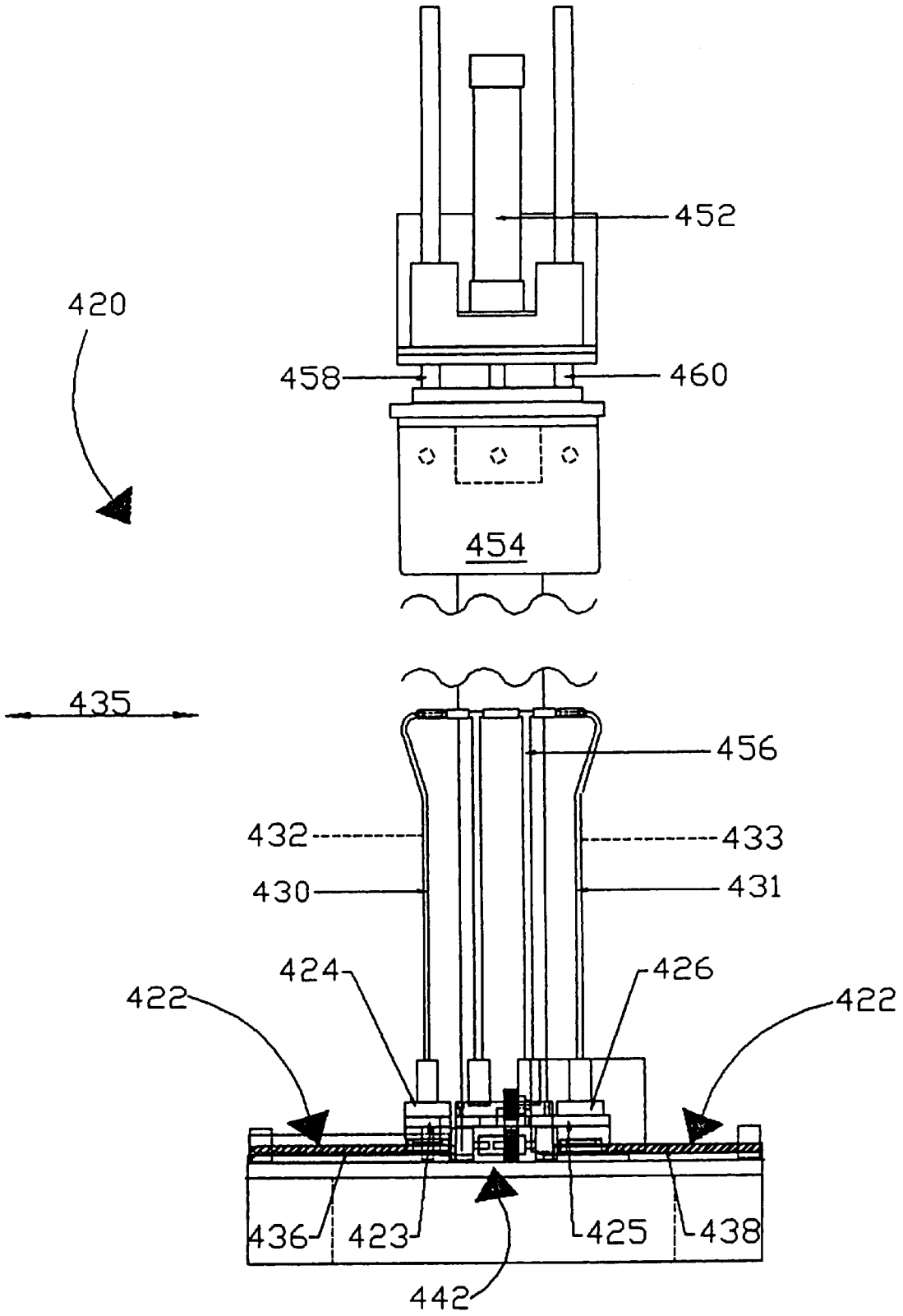
FIG. 8 is a front elevational view of the machine of FIG. 7.
Figure 9:
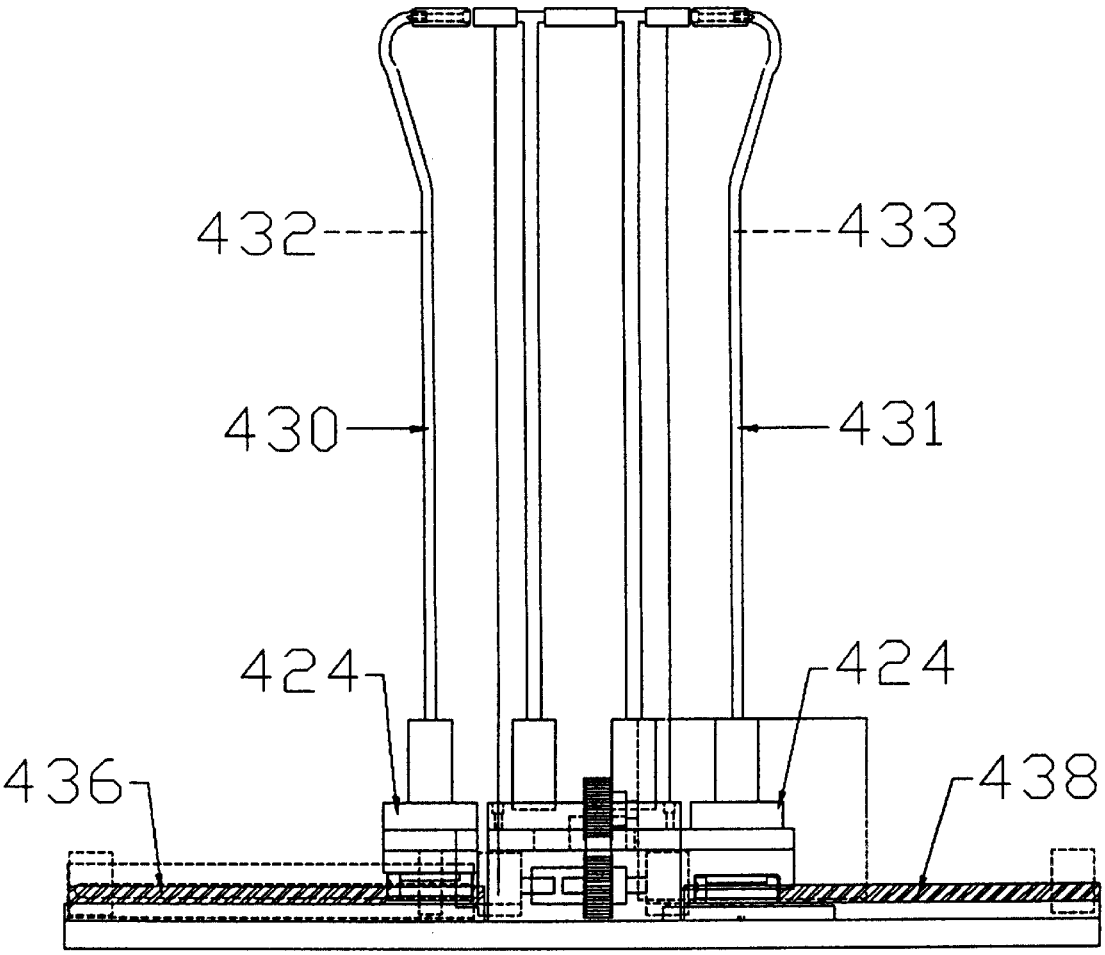
FIG. 9 is an enlarged fragmentary view of a portion of FIG. 8.
Figure 10:
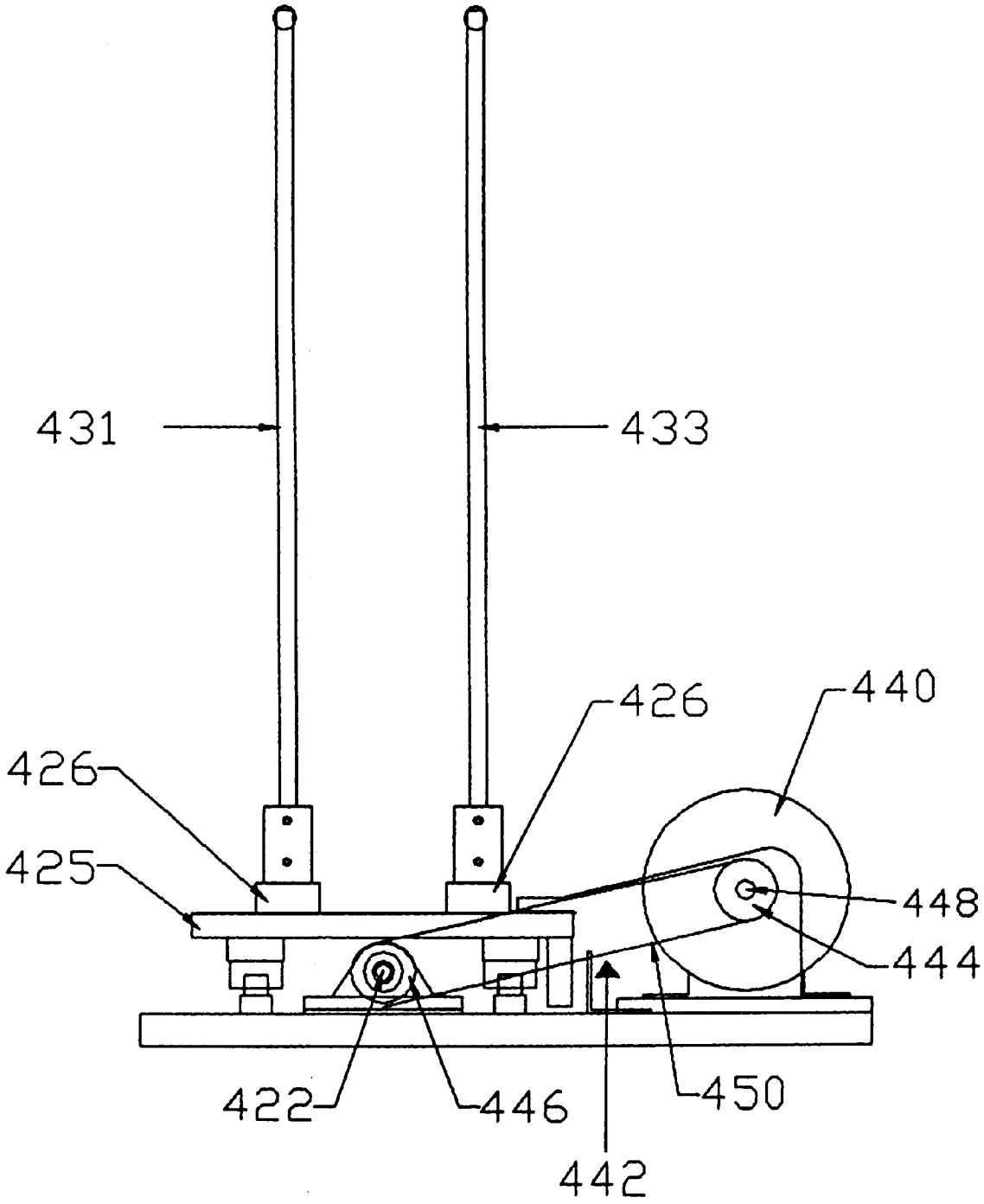
FIG. 10 is an enlarged fragmentary view of a portion of FIG. 7.

Referring to FIGS. 5 and 6, a second embodiment of the present invention is illustrated as the stand alone type in which a mounting bracket 200 which is adapted to hold a padded seat frame is reciprocated vertically upon the stanchion rods 290–295. The bracket 200 is mounted on the horizontal support 244 which in turn is slidably mounted to the frame 234. The horizontal support 244 reciprocated by the actuating means, in this case the electrical actuator 252 to successively drive the bracket down upon the stanchion rods 290–295 to skin seat covers on padded seat frames. The relative vertical positions (and relative movement relative to the frame) of the carriage and the bracket for holding the padded seat frame are thus reversed in this embodiment. The carriage 230 in this embodiment is fixed in the Y axis and rotatable about the Y axis. The stanchion rods 90–96 are similarly connected to support bases 300–305 which can be driven apart by at least one actuated screw in the form of a screw shaft 322 in the Z axis and at least one actuated screw in the form of a screw shaft 332 in the X axis. The operation and configuration of the carriage is similar to that of the first embodiment and will be understood from reference to the first embodiment and therefore will not be discussed further.

Referring to FIGS. 7–10, a lower cost third embodiment incorporating some of the features of the previous embodiments is illustrated as the stand alone type as well similar in some respects to that of the second embodiment. However, the third embodiment is a machine 420 that only includes one actuated screw in the form of a split screw shaft 422 that selectively moves two separate bases 424, 426 carrying respective sets of outside stanchion rods 430–433 toward each other or away from each other in only the X axis 435. The split screw shaft 422 includes opposite hand threads 436, 438 on respective portions of the shaft 422 which threadingly and engage threaded surfaces of support plates 423, 425 which carry the support bases 424, 426 such that rotation of the screw shaft 422 in one direction causes the support bases 424, 426 and therefore the rods to move closer together and rotation of the screw shaft 422 in the other direction causes the support bases 424, 426 and therefore the rods to move farther apart.

The mechanism for actuating the screw shaft 422 is also a simple bi-directional ac or de rotary motor 440 not of the servo type (but could be of the servo type if so desired). The motor 440 is mounted securely on the frame of the machine 420 and coupled to the shaft 422 by a direct drive in the form of a chain drive 442. The belt drive 442 includes two sprockets 444, 446 coupled to the motor output shaft 448 and the screw shaft 422, respectively. An endless chain 450 or alternatively an endless belt is entrained around the sprockets 444, 446 to transfer motion from the motor 440 to the screw shaft.

Another lower cost alternative illustrated in this embodiment is that the means for facilitating relative movement between the padded seat frames and the seat covers has been changed to fluid actuation. Specifically, the frame includes a stationary horizontal support 450 which carries a pneumatic cylinder 452 which actuates a bracket 454 for holding the padded seat frames. The bracket 454 is reciprocated upon the outer stanchion rods 430–433 and center stanchion rods 456 which receive seat covers inside out, thereby to successively install seat covers on padded seat frames. The bracket 454 is guided by guide rods 458, 460 to maintain the angular orientation of the bracket 454.

The positions of the stanchion rods 430–433, 456 may also be manually adjusted through a fastener mechanism. Specifically, fasteners may be used to selectively position the stanchion bases 424, 426 relative to the support plates 423, 425 in the Z axis (as well as for those for the center stanchion rods 456). This can generally be referred to as a an adjustable slot and fastener mechanism.

All of the references cited herein, including patents, patent applications and publications are hereby incorporated in their entireties by reference. While this invention has been described with an emphasis upon preferred embodiments, it will be obvious to those of ordinary skill in the art that variations of the preferred embodiments may be used and that it is intended that the invention may be practiced otherwise than as specifically described herein. Thus, this invention includes all modifications encompassed within the spirit and the scope of the invention as defined by the following claims.

What is claimed is:

1. A machine for installing seat covers on padded seat frames having mutually perpendicular X, Y, and Z axes, comprising:

a frame;

a seat cover carriage carried by said frame;

a cluster of support bases carried by the carriage, a cantilever aim mounted to each support base and extending longitudinally away from the seat cover carriage in the Y axis, the support bases being spaced apart in the X and Z axes, a plurality of the support bases being movable relative to the each other in at least one of the X and Z axes wherein the cantilever arms are adapted to be selectively spaced apart in the X and Z axes for receiving a selected size of seat cover; and at least one screw actuating at least one of the support bases, rotation of the screw positioning the at least one of the support bases relative to the other support bases;

an operator device coupled to the at least one screw, the operator device adapted to rotate the at least one screw to selectively position the at least one support base relative to the other support bases;

an actuator for facilitating relative reciprocating movement between the seat cover carriage and padded seat frames, the outer extremity of the cantilever arms adapted to closely following the contour of the padded seat frames during said reciprocating movement to thereby install seat covers on padded seat frames.

2. The machine of claim 1 wherein the operator device comprises an electrical motor.

3. The machine of claim 2 wherein the electrical motor is a servo motor having a rotational output directly coupled to the at least one screw.

4. The machine of claim 3 further comprising a programmed electronic controller in electrical communication with the servo motor, the electronic controller operable to selectively drive the servo motor to move the cantilever arms to a plurality of predetermined positions.

5. The machine of claim 2 wherein the electrical motor has an output shaft connected to the screw by a direct drive, the direct drive including a first sprocket connected to the output shaft, a second sprocket connected to the screw and an endless carrier entrained around the sprockets.

6. The machine of claim 1 wherein the carriage is movable in the Y axis with respect to the frame for reciprocation to and from padded seat frames to provide said relative reciprocating movement.

7. The machine of claim 6 wherein the carriage is mounted for rotation with respect to the frame about the Y axis, and further comprising a rotary actuator for selecting rotating the carriage in a selected angular position about the Y axis.

8. The machine of claim 6 wherein the carriage is linearly movable with respect the frame in the Z axis for aligning the cantilever arms relative to the position of the padded seat frame, the carriage adapted to be moved in the Z axis to a selected position and locked into the selected position.

9. The machine of claim 1 wherein the at least one screw positions the cantilever arms at a plurality of fixed positions, each different position corresponding to a different size of seat cover.

10. The machine of claim 9 wherein the at least one screw is fixed during each reciprocating movement of the machine when seat covers are installed on padded seat frames.

11. A machine for installing seat covers on padded seat frames having mutually perpendicular X, Y, and Z axes, comprising:

a frame;

a seat cover carriage carried by said frame;

a cluster of support bases carried by the carriage, a cantilever arm mounted to each support base and extending longitudinally away from the seat cover carriage in the Y axis, the support bases being spaced apart in the X and Z axes, a plurality of the support bases being movable relative to the each other in at least one of the X and Z axes wherein the cantilever arms are adapted to be selectively spaced apart in the X and Z axes for receiving a selected size of seat cover; and at least one first screw aligned in the X axis actuating at least one of the support bases, rotation of the screw positioning at least one of the support bases relative to the other support bases in the X axis;

means for controllably rotating the at least first one screw to selectively position the at least one support base;

at least one second screw aligned in the Z axis actuating at least one of the support bases, rotation of the screw positioning at least one of the support bases relative to the other support bases in the Z axis;

means for rotating the at least second one screw to selectively position the at least one support base;

actuating means for facilitating relative reciprocating movement between the seat cover carriage and padded seat frames, the outer extremity of the cantilever arms adapted to closely follow the contour of the padded seat frames during said reciprocating movement to thereby install seat covers on padded seat frames.

12. The machine of claim 11 wherein the first and second rotating means comprise electrical servo motors having a rotational output directly coupled to the at least one screw.

13. The machine of claim 12 further comprising a programmed electronic controller in electrical communication with the servo motors, the electronic controller operable to selectively drive the servo motors to move the cantilever arms to a plurality of predetermined discrete positions.

14. The machine of claim 11 wherein the carriage is movable in the Y axis with respect to the frame for reciprocation to and from padded seat frames to provide said relative reciprocating movement.

15. The machine of claim 14 wherein the carriage is mounted for rotation with respect to the frame about the Y axis, and further comprising a rotary actuator for selecting rotating the carriage in a selected angular position about the Y axis.

16. The machine of claim 14 wherein the carriage is linearly movable with respect the frame in the Z axis for aligning the cantilever arms relative to the position of the padded seat frame, the carriage adapted to be moved in the Z axis to a selected position and locked into the selected position.

17. The machine of claim 11 wherein the at least one first and second screws position the cantilever arms at a plurality of fixed positions, each different position corresponding to a different size of seat cover.

18. The machine of claim 17 wherein the at least one first and second screws are fixed during each reciprocating movement of the machine when seat covers are installed on padded seat frames.

19. A machine for installing seat covers on padded seat frames having mutually perpendicular X, Y, and Z axes, comprising:

a frame;

a seat cover carriage carried by said frame;

a cluster of support bases carried by the carriage, a cantilever arm mounted to each support base and extending longitudinally away from the seat cover carriage in the Y axis, the support bases being spaced apart in the X and Z axes for receiving a selected size of seat cover; and means including a screw for facilitating reciprocating movement between the seat cover carriage and padded seat frames in the Y axis, the outer extremity of the cantilever arms adapted to closely follow the contour of the padded seat frames during said reciprocating movement to thereby install seat covers on padded seat frames;

an electrical actuator coupled to the at least one screw, the actuator adapted to rotate the screw to cause said reciprocating movement; and electronic control means for adjusting the distance of the reciprocating movement to allow different lengths of seat to be used with the machine.

20. The machine of claim 19 wherein the electrical actuator is a servo motor.

* * * * *